United States Patent [19]

Mahajan et al.

[11] Patent Number: 4,851,193

[45] Date of Patent: Jul. 25, 1989

[54] HIGH TEMPERATURE ALUMINUM-BASE ALLOY

[75] Inventors: Yashwant R. Mahajan, Pune, India; Young-Won Kim, Dayton; Francis H. Froes, Xenia, both of Ohio

[73] Assignee: The United States of America as represented by the Secretary of the Air Force, Washington, D.C.

[21] Appl. No.: 310,448

[22] Filed: Feb. 13, 1989

[51] Int. Cl.[4] ..... C22C 21/00

[52] U.S. Cl. ..... 420/550; 420/551

[58] Field of Search ..... 420/550, 551, 528; 148/437

[56] References Cited

U.S. PATENT DOCUMENTS 4,806,307 2/1989 Hirose et al. ..... 420/528

*Primary Examiner*—R. Dean

*Attorney, Agent, or Firm*—Charles E. Bricker; Donald J. Singer

[57] ABSTRACT

An improved alloy consisting essentially of about 6 to 10 weight percent Fe, about 3 to 10 weight percent Gd, balance Al. The alloy may also contain minor amounts of one or more refractory metals.

4 Claims, No Drawings

HIGH TEMPERATURE ALUMINUM-BASE ALLOY

RIGHTS OF THE GOVERNMENT

The invention described herein may be manufactured and used by or for the Government of the United States for all governmental purposes without the payment of any royalty.

BACKGROUND OF THE INVENTION

This invention relates to aluminum alloys.

Aluminum alloys have been widely used in applications such as aircraft where a high strength to weight ratio is desired. However, for applications at elevated temperatures, beyond about 300° F., aluminum is often considered less suitable than metals such as titanium, because temperatures in that range degrade the strength of conventional aluminum alloys produced from ingot.

One approach to improve the elevated temperature performance of aluminum components is to utilize alloys that are fabricated from rapidly solidified aluminum base materials which rely on fine intermetallic particles for dispersion strenghthening. It has been reported that aluminum alloy powder products containing iron with or without manganese, nickel, cobalt, chromium, vanadium, titanium, zirconium or silicon have improved strength at elevated temperatures. It has been reported that aluminum-iron-cerium powder products have very high strength at elevated temperatures.

SUMMARY OF THE INVENTION

In accordance with the present invention, there is provided an improved alloy consisting essentially of about 6 to 10 weight percent Fe and about 3 to 10 weight percent Gd, balance aluminum. In a presently preferred embodiment, the weight ratio of iron to gadolinium is in the range of about 1:1 to 2.2:1. In addition to aluminum, iron and gadolinium, the alloy can contain refractory metals of at least about 0.1 wt. percent and up to about 1.0 wt. percent tungsten, 1.0 wt. percent tantalum, 1.5 wt. percent molybdenum, and/or 1.5 wt percent niobium. Preferably, the total amount of these strengtheners should not exceed about 5 wt. percent and preferably should not exceed the iron and gadolimium content.

The alloys are produced by any of the known rapid solidification processes for producing particulate materials. Suitable processes include gas atomization, drum splat, twin roll atomization, chill block melt spinning, planar flow casting, and the like. It is preferred that any such process be carried out under non-oxidizing conditions in order to achieve a low oxide content in the particulate material.

The particulate material is compacted to full density or substantially full density using compaction techniques known in the art. Prior to compaction, the particulate material may be compressed into a cohesive or coherent shape using known compression techniques. In general, compaction is carried out at an elevated temperature of about 600° to 950° F. (315° to 510° C.) at pressure of about 5 to 60 ksi.

After being compacted to at least substantially full density, the resulting compact can be further shaped, such as by forging, rolling, extruding, machining, or the like.

The following example illustrates invention:

A series of alloys having the composition shown in Table I, below, were repeated into button forms by repeated arc melting. The alloy buttons were then induction melted in a quartz crucible to a superheat of about 100° C., then ejected under argon gas pressure through a nozzle onto a rapidly rotating (surface velocity =20 m/s) water cooled copper wheel. The melt-spun ribbon thus produced had an average thickness of about 50 μm.

TABLE 1

| Chemical Composition, wt percent | |
|---|---|
| Nominal | Actual |
| Al—8Fe | Al—8.16Fe |
| Al—8Fe—4Ce | Al—7.82Fe—4.03Ce |
| Al—8Fe—4Nd | Al—8.57Fe—4.56Nd |
| Al—8Fe—4Gd | Al—7.60Fe—4.20Gd |
| Al—8Fe—4Er | Al—7.55Fe—4.22Er |

The actual compositions of the above ribbons were determined by chemical analysis after melt-spinning.

The ribbons were isochronally annealed in vacuum for one hour at 600° C. X-ray diffraction was used to identify phases in both the as-melt-spun and the 600° C. annealed conditions of the ribbons. The phases identified are shown in Table II, below. In the as-melt-spun condition, the amount of intermetallic compounds is reduced by the addition of rare earth elements, with Gd being the most effective. Further, the addition of rare earth elements virtually eliminates the formation of $Al_3Fe$ type compounds but results in the formation of Al-Fe-Rare Earth compounds. The ternary compounds appear to be isostructural with $Al_{10}Fe_2Ce$.

TABLE II

| | Phases Identified | | | |
|---|---|---|---|---|
| | As Melt-Spun | | After Annealing (600° C. 1 hr) | |
| Alloy | Phase | Quantity* | Phase | Quantity* |
| Al—8F2 | $Al_6Fe$ | M | $Al_3Fe$ | L |
| | $Al_3Fe$ | VS | | |
| Al—8Fe—4Ce | Al—Fe—Ce+ | S | $Al_3Fe$ | L |
| | $Al_6Fe$ | S | $Al_{10}Fe_2Ce$ | L |
| Al—8Fe—4Nd | Al—Fe—Nd+ | S | $Al_3Fe$ | M |
| | $Al_6Fe$ | VS | $Al_{10}Fe_2Nd$ | L |
| Al—8Fe—4Gd | Al—Fe—Gd+ | VS | $Al_3Fe$ | S |
| | $Al_6Fe$ | VVS | $Al_{10}Fe_2Gd$ | L |
| Al—8Fe—4Er | Al—Fe—Er+ | S | $Al_3Fe$ | M |
| | $Al_6Fe$ | VS | $Al_{10}Fe_2Er$ | L |

*VVS = extremely small amount
VS = very small amount
S = small amount
M = medium amount
L = large amount The alloy of the present invention may be employed to fabricate articles by powder metallurgy, using known techniques. An important advantage of this alloy is that because of the larger amount of the ternary compound and, concomitantly, the largest amount of the preferred globular shaped particles, degassing and compaction processes can be carried out at higher temperatures.

Various modifications may be made in the present invention without departing from the spirit thereof or the scope of the appended claims

We claim:

1. An improved aluminum-base alloy consisting essentially of about 6 to 10 weight percent Fe and about 3 to 10 weight percent Gd, balance aluminum.

2. The alloy of claim 1 containing about 8 weight percent iron, 4 weight percent Gd, balance Al.

3. The alloy of claim 1 further containing about 0.1 to 1.0 weight percent tungsten, about 0.1 to 1.0 weight percent tantalum, about 0.1 to 1.5 weight percent molybdenum, or about 0.1 to 1.5 weight percent niobium.

4. The alloy of claim 1 wherein the weight ratio of Fe to Gd is about 1:1 to 2.2:1.

* * * * *